US008101889B2

(12) United States Patent
Uno

(10) Patent No.: US 8,101,889 B2
(45) Date of Patent: Jan. 24, 2012

(54) DRAWER TYPE COOKING DEVICE

(75) Inventor: Masayuki Uno, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 140 days.

(21) Appl. No.: 12/560,747

(22) Filed: Sep. 16, 2009

(65) Prior Publication Data

US 2010/0072187 A1 Mar. 25, 2010

(30) Foreign Application Priority Data

Sep. 19, 2008 (JP) ..... 2008-240923

(51) Int. Cl.
*F27D 5/00* (2006.01)
*G05B 5/00* (2006.01)

(52) U.S. Cl. ..... 219/392; 219/390; 219/402; 219/403; 318/461; 318/466; 318/467; 318/253; 318/300

(58) Field of Classification Search ..... 219/390, 219/392, 402, 403; 318/461, 466, 467, 253–300
See application file for complete search history.

(56) References Cited

U.S. PATENT DOCUMENTS 7,414,225 B2 * 8/2008 Yoshidome et al. ..... 219/392

FOREIGN PATENT DOCUMENTS

| | | | |
|---|---|---|---|
| JP | 51-120450 | A | 10/1976 |
| JP | 54-035440 | A | 3/1979 |
| JP | 55-159916 | S | 11/1980 |
| JP | 61-96211 | U | 6/1986 |
| JP | 3-45820 | A | 2/1991 |
| JP | 6-109257 | A | 4/1994 |
| JP | 11-237053 | A | 8/1999 |
| JP | 2006-207913 | A | 8/2006 |
| JP | 4027325 | B2 | 12/2007 |

* cited by examiner

*Primary Examiner* — Shawntina Fuqua
(74) *Attorney, Agent, or Firm* — Birch, Stewart, Kolasch & Birch, LLP

(57) ABSTRACT

In a built-in drawer type cooking device, an open/close door 2*a* and a heating container 2*b* that constitute a drawer body 2 are separably connected to each other. The open/close door 2*a* and the heating container 2*b* are connected via an insulator 10 to prevent a discharge phenomenon due to emission of microwaves. The open/close door 2*a* and the heating container 2*b* can be separated from each other with the drawer body 2 being drawn out, and thus the heating container 2*b* can be taken out of the cooking device and cleaned or wholly washed. An inner wall surface of a heating chamber 3 that is easily contaminated can be cleaned while being visually checked. The heating container 2*b* and the open/close door 2*a* are separately produced, and can be individually stored, conveyed and stacked, thereby reducing a rejection rate due to deformation and increasing productivity in an assembling process.

4 Claims, 3 Drawing Sheets

DRAWER TYPE COOKING DEVICE

The present application is based on and claims priority of Japanese patent application No. 2008-240923 filed on Sep. 19, 2008, the entire contents of which are hereby incorporated by reference.

BACKGROUND OF THE INVENTION

1. Field of the Invention

The present invention relates to a drawer type cooking device in which a heating container that contains an object to be heated can be drawn out of a heating chamber formed in a body of the cooking device by an operation of an open/close door.

2. Description of the Related Art

Conventionally, a cooking device has been proposed including: a device body including a cooking chamber that contains an object to be cooked; an open/close door that blocks off the cooking chamber from outside; a bottom plate that interlocks with the open/close door; a slide mechanism that slides the bottom plate; a motor that drives the bottom plate; transmission means that transmits a drive force of the motor to the bottom plate; a latch device that holds the open/close door in a closed state; a door open/close switch; and a control circuit that controls driving of the motor so as to receive a signal from the door open/close switch and operate the open/close door (Japanese Patent Laid-Open Publication No. 3-45820 (Patent Document 1)). When the door open/close switch is operated, the latch is automatically released, the force of the motor causes the open/close door to interlock with the bottom plate and gradually slide toward a front surface of the device, thereby facilitating loading and unloading of an object to be cooked. The bottom plate is directly connected to a lower portion near a lower side of the open/close door, and sides of the bottom plate are opened when the open/close door is opened. The open/close door that blocks off the cooking chamber from the atmosphere is provided integrally with the bottom plate, and thus when the bottom plate is driven by the motor, the open/close door is interlockingly moved. In the bottom plate, a bent portion is held between a first roller and a second roller provided at each side end, and the bottom plate is integrally provided in a door open/close direction by a third roller provided in a rear portion of the bottom plate.

A cooking device has been also proposed in which a drawer body that contains an object to be heated is drawably provided in a cooking device body, including: detection means for detecting that the drawer body is drawn out; control means for outputting an excitation command signal when a detection signal is provided from the detection means; and an electromagnet leg provided on a bottom surface of the cooking device body and excited when the excitation command signal is provided (Japanese Patent Laid-Open Publication No. 6-109257 (Patent Document 2)). When the drawer body is drawn out, the control means outputs the excitation command signal on the basis of detection by the detection means, and the electromagnet leg provided on the bottom surface of the cooking device body is excited. Movement of the center of gravity caused by drawing easily causes falling over of the entire cooking device, but the electromagnet leg sticks to a metal loading surface of a counter or the like to prevent falling over of the cooking device and allow the drawer type cooking device to be always used in a stable state.

A microwave oven has been also proposed in which a heating container having an opening in an upper portion is provided drawably from a body housing, the heating container and a lid provided on the body housing and covering the opening of the heating container constitute a heating chamber that confines microwaves, and a choke groove is provided between an opening peripheral edge of the heating container and the lid facing the opening peripheral edge to prevent leakage of radio waves, thereby preventing leakage of radio waves even with a drawer structure having a movable food loading portion (Japanese Patent Laid-Open Publication No. 11-237053 (Patent Document 3)). A front surface of the heating container serves as an open/close door that blocks off the heating chamber from outside air.

FIG. 3 is a perspective view of a drawer type cooking device equal to that already proposed by the applicant, and FIG. 4 is a sectional view of a drawer body being drawn out of a cooking device body in the drawer type cooking device shown in FIG. 3. The cooking device body 1 includes a heating chamber 3 for cooking an object to be heated. The drawer body 2 includes an open/close door (hereinafter abbreviated as "door") 2*a* for opening and closing the heating chamber 3 and a heating container 2*b* having a container shape for receiving and containing the object to be heated. The drawer body 2 is placed slidably in the cooking device body 1 by a slide mechanism 4 so as to be drawn forward from an inside of the heating chamber 3 of the cooking device body 1. The slide mechanism 4 is placed on each of right and left side wall surfaces located outside the heating chamber 3. The slide mechanism 4 is provided outside the heating chamber 3, and thus a movable rail 8 and a fixed rail 9 that constitute the slide mechanism 4 need not be formed of expensive components or materials having high heat resistance and flame retardancy, also the slide mechanism 4 is not influenced by microwaves applied in the heating chamber 3, and there is no risk of electric discharge by microwaves (Japanese Patent Publication No. 4027325 (Patent Document 4)).

The slide mechanism 4 includes, though not specifically shown, the fixed rail secured to the cooking device body 1 and the movable rail that slides along the fixed rail. The movable rail is connected to the door 2*a*, and thus the drawer body 2 is supported slidably via the door 2*a* and the slide mechanism 4 to the cooking device body 1. To drive the slide mechanism 4, for example, a DC motor is provided as a drive mechanism. Though not specifically shown, a pinion coupled to a rotation output shaft of the DC motor via a transmission mechanism engages a rack mounted to the movable rail, and rotation of the pinion causes a linear motion of the rack to drive the slide mechanism 4 and drive the drawer body 2.

The heating container 2*b* includes side walls on lateral sides and a rear wall on a back side located in the heating chamber 3 of the cooking device body 1, and an upper portion thereof is an opening for loading and unloading the object to be heated. The door 2*a* is mounted to a front of the heating container 2*b*. The door 2*a* and the heating container 2*b* are previously assembled and cannot be disassembled in a normal state of use, and serve and are handled as an integral component. The door 2*a* closes an opening 3*a* of the heating chamber 3, and thus an inner space of the heating chamber 3 is sealed by an inner wall surface of the cooking device body 1 and the drawer body 2 to prevent leakage of microwaves. The door 2*a* has an operation unit 9 for opening and closing operations by a user, and the operation unit 9 includes a control portion 5 and an operation button 9*a*.

In producing the drawer body provided in the heating chamber that is filled with microwaves during cooking, the door 2*a* and the heating container 2*b* that are components of the drawer body are electrically welded and integrated. Electrical welding is selected as connection means because the components can be fastened and joined in a shorter time than by other fastening means to increase productivity and also because electrical joining of metals ensures conductivity or electrical continuity between the components so that the same electric potential is generated in the both components by eddy current electromagnetically induced by microwaves during cooking, thereby preventing discharge between the components. With such a great advantage, the conventional drawer type cooking device uses the structure in which the door 2*a* and the heating container 2*b* are electrically welded and integrated.

The heating container part of this drawer body needs heat resistant coating for preventing contamination or corrosion caused by water vapor generated during cooking, droplets from an object to be heated, or condensation water after cooking, but the components with coated surfaces by coating cannot be electrically welded and thus welding needs to be performed before the coating.

In this case, the following coating process is performed.

1. Degreasing (a steel plate is immersed in a degreasing liquid having a function of dissolving oils and fats to remove oils and fats adhering to a surface of the steel plate during press working of the steel plate.)

2. Primer coating (the steel plate as a material is immersed in a primer liquid to form an intermediate conductive film compatible with both a steel plate surface and a coating film on the steel plate surface.)

3. Electrocoating (the steel plate is immersed in an electrolyte tank containing a coating material, and a heat-resistant reliable coating film without a pinhole is formed on a primer film on the steel plate surface by an electrochemical process using a drawer body as an electrode.)

The welded assembly of the drawer body immediately before coating has an irregular shape because the heating container having a rectangular box shape and the open/close door having a plate shape are connected. Thus, when the assembly is immersed and treated in a treatment liquid such as the degreasing liquid, the primer liquid, or the electrolyte as described above in each step, the treatment liquid used in each step remains in a recess or the like in the steel plate and cannot be sufficiently removed, and is carried over to the treatment liquid in the next step as impurity. In addition, the treatment liquid in the previous step remains in the surface of the assembly, which may hinder the treatment in the next step. For example, there is a possibility of a poor coating appearance, that is, a possibility that the degreasing liquid or the primer liquid remains to prevent contact between the steel plate surface and the electrolyte in electrocoating and thus prevent the coating material from adhering to the steel plate surface, or the coating film does not adhere to the steel plate and is easily removed because a film of the degreasing liquid or the primer liquid is interposed therebetween.

Also, when the drawer body having the irregular shape is conveyed between the steps, insertion of a shock absorber or securing of the assembly is difficult, and contact or collision between drawer bodies or between the drawer body and a conveying medium may cause flaws, dents or the like, thereby providing a poor appearance. Preventing such a problem generally requires much more careful confirmation and adjustment than those in assembly and coating of components having simple shapes, which increases a time for coating.

Thus, in the conventional drawer type cooking device, the heating container 2*b* is integrated with the door 2*a*, and the heating container 2*b* is drawable so as to be pushed in and drawn out of the heating chamber 3 of the cooking device body 1. Meanwhile, a wall surface of the heating chamber 3 is contaminated by droplets from the object to be heated with increasing number of cooking. When a back or a corner of the heating container 2*b* or a ceiling surface of the heating chamber 3 is contaminated, such a portion is hard for a user to visually check and reach in cleaning partly because the drawer type cooking device is installed immediately below a cooking counter, and thus completely cleaning the contamination is difficult.

A panel (metal) of the door 2*a* that constitutes the open/close door needs surface treatment (coating) to prevent interference with electromagnetic induction by microwaves. However, the heating container 2*b* is integrated with the door 2*a* to constitute the drawer body, thus a ceiling surface of the assembly has an uneven height, and stacking is extremely difficult in storage and movement between steps in a production process, there is a high possibility of deformation in carrying, and assembling and setting require a large space, thereby reducing productivity and yield with a high rejection rate.

Thus, there is a problem to be solved for providing a drawer type cooking device in which an open/close door as a front surface and a heating container that receives an object to be heated that are conventionally integrated as a drawer body can be separated from each other without loss of basic performance such as strength required as a drawer body or appearance accuracy.

The present invention has an object to solve the above described problem and provide a drawer type cooking device that allows cleaning of a heating container with a heating container being removed from an open/close door, allows easy cleaning of contamination on an inside of a heating chamber such as a ceiling, and facilitates assembling after individual production and coating or the like of the open/close door and the heating container even in a production stage.

SUMMARY OF THE INVENTION

To achieve the above described object, the present invention provides a drawer type cooking device including: a cooking device body having a heating chamber formed therein; a drawer body that includes a heating container which can contain an object to be heated and is drawable from an inside of the heating chamber and an open/close door which can close the heating chamber; and a slide mechanism that can slidingly guide the drawer body in a draw-out direction outside the heating chamber, wherein the heating container of the drawer body is separably connected to an inner side wall of the open/close door.

With the drawer type cooking device, the drawer body can be drawn out of or pushed into the heating chamber by the slide mechanism that slidingly guides the drawer body in the draw-out direction outside the heating chamber, and the open/close door closes the heating chamber with the drawer body being pushed into the heating chamber to prevent leakage of microwaves to the outside during cooking. The heating container of the drawer body is separably connected to the inner side wall of the open/close door, and thus with the drawer body being drawn out, a connecting portion connecting the heating container to the inner side wall of the open/close door becomes accessible from above, and the connecting portion is separated to allow the heating container to be disconnected from the open/close door. The heating container separated from the open/close door can be taken out through a space opened above the open/close door and the heating chamber.

In the drawer type cooking device, a drive mechanism can be provided that is connected to the slide mechanism via a transmission mechanism and drives the drawer body in a push-in/draw-out direction. The drive mechanism drives the slide mechanism via the transmission mechanism to allow the drawer body to be automatically drawn out or pushed in. Thus, even if a user has insufficient physical ability such as insufficient muscle force, eyesight or hearing, the user can close the door without a need to push the door against a repulsive force of a latch. Also, the open/close door of the cooking device can be reliably held in a closed state and cooking can be performed without a need to visually or audibly check a fastening operation of the latch. Thus, safety in use of the cooking device can be ensured, which is particularly suitable for a relatively large cooking device as a household cooking device.

In the drawer type cooking device, the slide mechanism is preferably connected to the open/close door. The slide mechanism is connected to the open/close door to allow the heating container to be taken out with the open/close door being supported on the cooking device body by the slide mechanism.

In the drawer type cooking device, the open/close door and the heating container are preferably joined via an insulator. The open/close door and the heating container are joined via the insulator to prevent discharge by microwaves.

In the drawer type cooking device, it is preferable that a roller that rolls on a bottom surface of the heating chamber in a draw-out direction is provided at a rear end of the heating container, and the heating container is lifted at a front end with the roller as a fulcrum with the drawer body being drawn out, and can be taken out of the heating chamber through a space between an upper edge of the open/close door and a front upper edge of the heating chamber. A part of the weight of the heating container including the weight of the object to be heated is supported by the open/close door via the slide mechanism at the front of the heating container, and the other part is supported by the bottom surface of the heating chamber via the roller. In movement of the drawer body, movement of the heating container is smoothly guided by rolling of the roller. Further, the roller provided at the rear end of the heating container is rollable. Thus, the heating container can smoothly change its position when lifted at the front end, and can be easily taken out, in its position, through the space between the upper edge of the open/close door and the upper edge of the heating chamber. The drawer type cooking device is installed immediately below a cooking counter, and thus taking out the heating container upward is an easy operation for the user.

The present invention is configured as described above, and the heating container and the open/close door are separated from each other to allow only the heating container to be removed from the drawer body, and thus the heating container easily contaminated by droplets or the like from the object to be heated can be cleaned or separately washed. With the heating container having bulkheads in side surfaces and a back surface being removed, the entire device including the inner wall of the heating chamber or the like can be easily visually checked, and the back of the heating chamber is easily accessible in cleaning, thereby facilitating cleaning of the inside of the heating chamber.

In the present invention, the heating container and the open/close door may be produced and stored in separate steps in a surface treatment process of the door panel, and assembled in a final assembling process for producing the cooking device. In separate storage and conveyance between steps in a production process, the rectangular heating container and the plate-shaped open/close door can be stacked in separate returnable boxes or the like and conveyed, thereby facilitating conveyance between steps and setting in the cooking device in the final assembling process, reducing a rejection rate due to deformation or the like in storage and conveyance, reducing production costs, and increasing productivity in the assembling process.

Further, in current coating, a white coating is applied to the heating chamber by surface treatment, while the same black coating is applied to the heating container and the open/close door because electrocoating of the heating container and the open/close door is simultaneously performed. However, the heating container and the open/close door are separately produced and worked to allow separate coating, allow independent selection of color of the heating container, and allow the same white coating as the heating chamber to be applied to the heating container.

The heating container has a simple outer shape similar to a rectangular shape, and simply interposing a sheet of a foam or the like as a shock absorber can prevent contact or collision in the production process. The drawer body has a simple rectangular box shape with an open maximum surface. Thus, even if coating is performed after assembling, there is no recess in which a treatment liquid remains, and the treatment liquid can be substantially completely removed simply by draining with a typical method such as leaving the drawer body with the open surface directed downward, providing a slight vibration, or blowing with dry air.

DETAILED DESCRIPTION OF THE INVENTION

Figure 1:
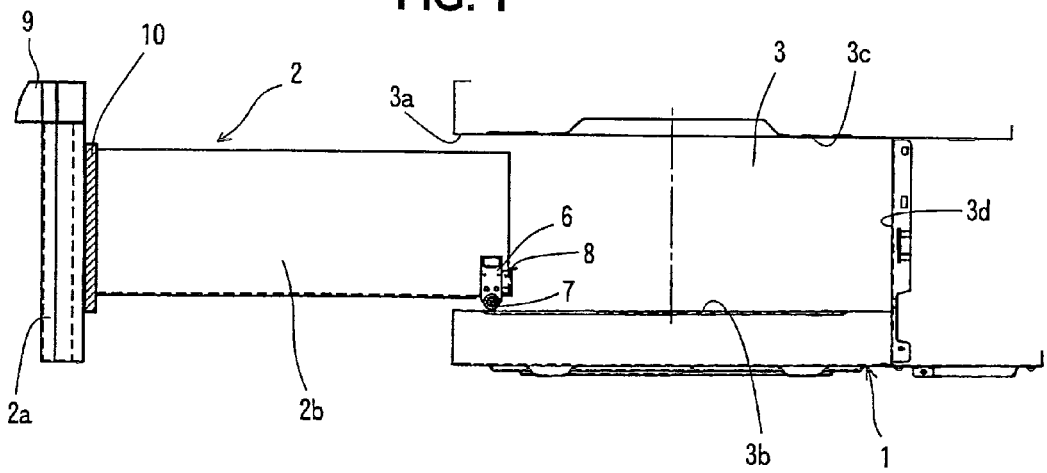
FIG. 1 is a side sectional view of an embodiment of a drawer type cooking device according to the present invention with an open/close door being opened.
Figure 2:
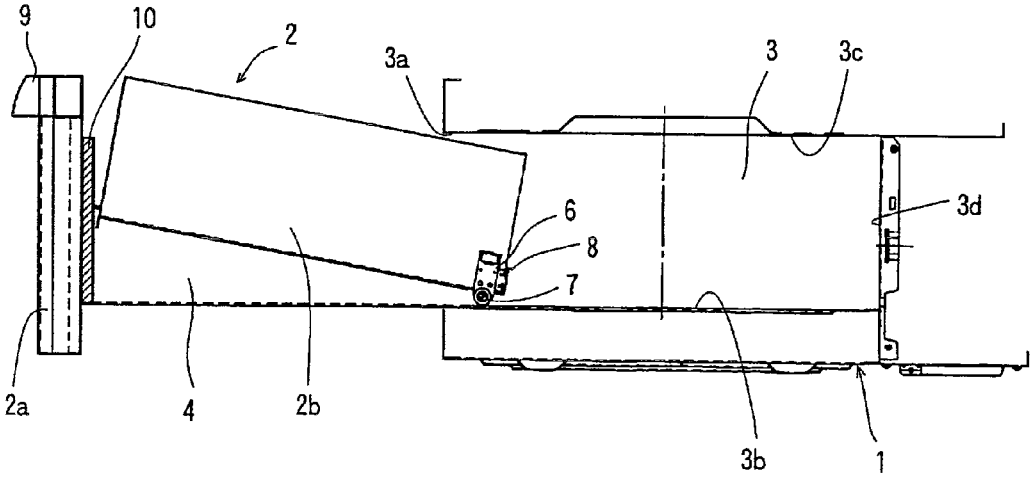
FIG. 2 is a side sectional view of the drawer type cooking device in FIG. 1 with the open/close door being opened.
Figure 3:
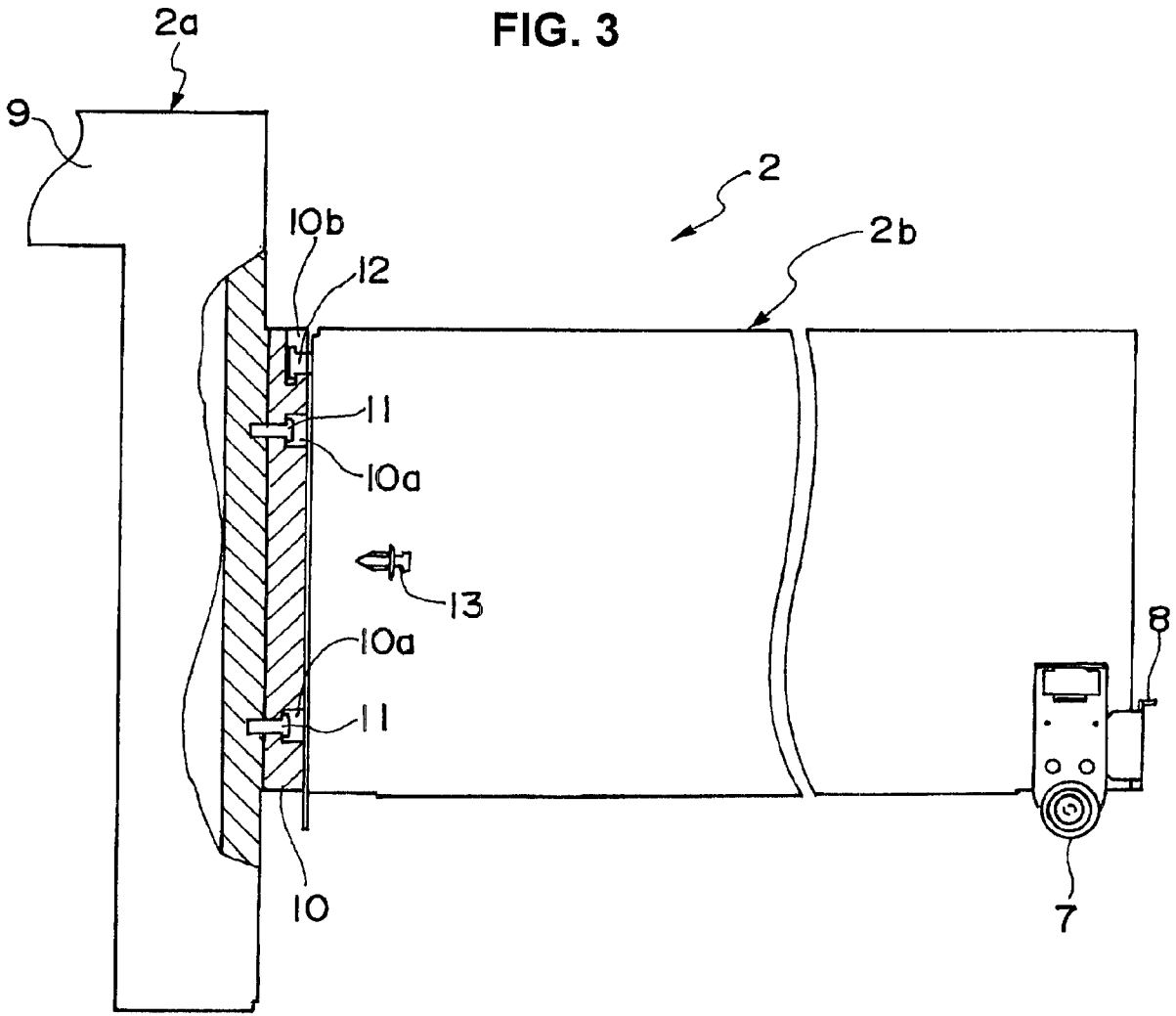
FIG. 3 is a sectional view of an example of a separable locking structure between the open/close door and a heating container in the drawer type cooking device according to the present invention.
Figure 4:
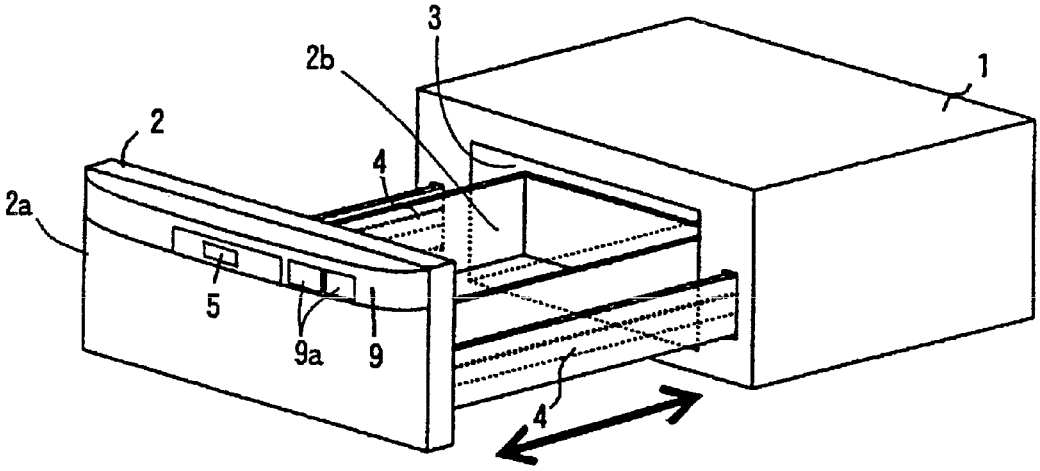
FIG. 4 is a perspective view of a conventional drawer type cooking device.
Figure 5:
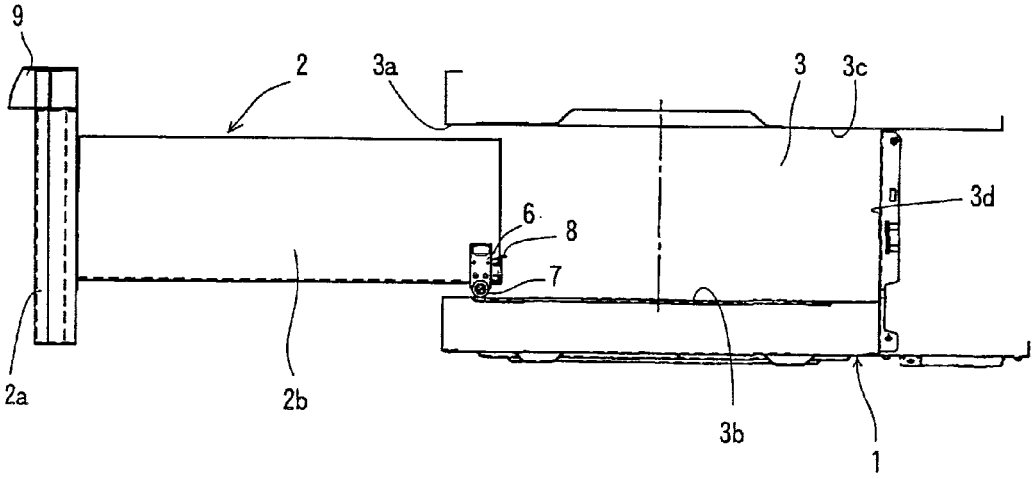
FIG. 5 is a side sectional view of the drawer type cooking device shown in FIG. 4 with an open/close door being opened.

Now, an embodiment of a drawer type cooking device according to the present invention will be described with reference to the accompanying drawings. FIG. 1 is a side sectional view of the embodiment of the drawer type cooking device according to the present invention, FIG. 2 shows a heating container separated from an open/close door being taken out in the drawer type cooking device in FIG. 1, and FIG. 3 is a sectional view of an example of a separable locking structure between the open/close door and the heating container. The configuration of the cooking device may be the same as that in FIGS. 4 and 5 except a structure of a drawer body.

In the drawer type cooking device in FIG. 1, the drawer body 2 is slidingly guided in a draw-out direction by a slide mechanism 4 outside a heating chamber 3 formed in the cooking device body 1, and can be drawn out of or pushed into the heating chamber 3. A drive force from a drive mechanism such as a DC motor is transmitted to the slide mechanism 4 via a transmission mechanism, and the drawer body 2 is driven in a push-in/draw-out direction and can be automatically drawn out, or pushed in. Such automatic pushing and drawing of the drawer body 2 is particularly suitable for a large cooking device.

With the drawer body 2 being pushed into the heating chamber 3, a door 2*a* closes an opening 3*a* of the heating chamber 3 to prevent leakage of microwaves to the outside. In the embodiment, a heating container 2*b* that can contain an object to be heated is separably connected to an inner side wall of the open/close door (door) 2*a* that can close the opening of the heating chamber 3. The connection structure between the door 2*a* and the heating container 2*b* is not easily separated by an impact or the like, but is a simple structure so that a user of the cooking device can easily separate using releasable securing means such as a hook or a friction grip.

A bracket 6 is mounted to a lower portion of a rear end of the heating container 2*b*, and a roller 7 that rolls on a bottom surface 3*b* of the heating chamber 3 in the draw-out direction is provided on the bracket 6. In movement of the drawer body 2, movement of the heating container 2*b* is smoothly guided by the roller 7 rolling on the bottom surface 3*b*. The roller 7 and the door 2*a* (thus the slide mechanism 4) share and support the weight of the heating container 2*b* including the weight of the object to be heated. Near the bracket 6, a latch 8 is provided that operates a full-close switch when the drawer body 2 is fully pushed in and the door 2*a* is located in a fully-closed position.

The door 2*a* and the heating container 2*b* are preferably joined via, for example, an insulator 10. As shown in FIG. 3, the insulator 10 is secured to the door 2*a* at a plurality of positions by screws (or rivets) 11. The insulator 10 is formed of ceramic or a plastic molded product that can provide a sufficient space distance between the door 2*a* and the heating container 2*b*. For reliable electrical joining with a metal part of the door 2*a*, screwing with a structure in which tight fitting between a male thread and a female thread ensures conductivity between metals is more advantageous.

To prevent discharge between a head of the screw 11 and the heating container 2*b*, a space distance may be ensured or a separate insulator may be inserted into a mounting hole 10*a* formed on the side of the heating container 2*b* in the insulator 10 after securing with the screw 11. This improves an appearance, prevents entry of dirt, and improves a cleaning property in contamination by droplets from the object to be heated. At an end of the heating container 2*b* on the side of the door 2*a*, a stepped rivet 12 is secured to each of left and right upper portions.

The stepped rivet 12 is fitted from above into a groove 10*b* in the insulator 10 mounted to the door 2*a*, thereby allowing the heating container 2*b* to be locked to the door 2*a*. After the heating container 2*b* is mounted to the door 2*a*, a push rivet 13 formed of an insulating material is preferably inserted to retain the heating container 2*b*. The door 2*a* and the heating container 2*b* are joined via the insulator 10 that provides the sufficient space distance therebetween and thus electrically insulated from each other, thereby preventing a discharge phenomenon between the door 2*a* and the heating container 2*b* due to electromagnetic induction by microwaves.

The stepped rivet 12 is simply fitted from above into the groove 10*b* in the insulator 10, and thus the heating container 2*b* can be easily separated from the door 2*a* by removing the stepped rivet 12 upward from the groove 10*b*. Thus, the door 2*a* and the heating container 2*b* of the drawer body 2 are separably connected to each other, and thus with the drawer body 2 being drawn out, the heating container 2*b* separated from the door 2*a* can be taken out of the heating chamber 3. Specifically, with the drawer body 2 being drawn out as in FIG. 1 (in this state, a rear portion of the heating container 2*b* is still partially located inside the heating chamber 3), the heating container 2*b* is separated from the insulator 10 provided on the inner side wall of the door 2*a*, then lifted at a front end with the roller 7 provided at the lower end as a fulcrum as shown in FIG. 2, and then taken out of the cooking device body 1 through a space between an upper edge of the door 2*a* and the opening 3*a* of the heating chamber 3. The roller 7 provided at the rear end of the heating container 2*b* is rollable, and thus the heating container 2*b* smoothly changes its position when lifted at the front end. The heating container 2*b* is further lifted at the front end to be easily taken out through the space between the upper edge of the door 2*a* and the upper edge of the heating chamber.

The slide mechanism 4 is connected to the door 2*a*, and thus when the heating container 2*b* is taken out, the door 2*a* and the slide mechanism 4 remain on the side of the cooking device body 1. The heating container 2*b* taken out can be cleaned or wholly washed in a different place or the like. A ceiling surface 3*c* and a rear surface 3*d* of the heating chamber 3 from which the heating container 2*b* is taken out can be easily visually checked by removing the heating container having bulkheads in side surfaces and a back surface, and also the user can easily reach the back of the heating chamber, thereby facilitating cleaning of the inside of the heating chamber.

What is claimed is:

1. A drawer type cooking device comprising:

a cooking device body having a heating chamber formed therein;

a drawer body that includes a heating container which can contain an object to be heated and is drawable from an inside of the heating chamber and an open/close door which can close the heating chamber;

a slide mechanism that can slidingly guide the drawer body in a draw-out direction outside the heating chamber; and a roller that rolls on a bottom surface of the heating chamber in a draw-out direction at a rear end of the heating container, wherein the heating container of the drawer body is separably connected to an inner side wall of the open/close door, and wherein the heating container is lifted at a front end with the roller as a fulcrum with the drawer body being drawn out, and configured to be taken out of the heating chamber through a space between an upper edge of the open/close door and a front upper edge of the heating chamber.

2. The drawer type cooking device according to claim 1, further comprising:

a drive mechanism that is connected to the slide mechanism via a transmission mechanism and drives the drawer body in a push-in/draw-out direction.

3. The drawer type cooking device according to claim 1 or 2, wherein the slide mechanism is connected to the open/close door.

4. The drawer type cooking device according to claim 1, wherein the open/close door and the heating container are joined via an electrical insulator.

* * * * *